United States Patent [19]

Malesky et al.

[11] 4,399,627

[45] Aug. 23, 1983

[54] FLEXIBLE CLEANING SHAFT WITH BRUSH ADAPTER

[76] Inventors: Edwin V. Malesky, 2727 Academy; Lawrence C. Malesky, 6 Waynewood Ct., both of Dearborn, Mich. 48124

[21] Appl. No.: 84,397

[22] Filed: Oct. 12, 1979

[51] Int. Cl.[3] ..... F41C 31/00

[52] U.S. Cl. ..... 42/1 BC; 15/104.16

[58] Field of Search ..... 42/1 R, 1 CP, 1 BC; 15/104.16, 104.165, 104.2; 285/176, 177

[56] References Cited

U.S. PATENT DOCUMENTS

| | | | |
|---|---|---|---|
| 1,000,108 | 8/1911 | Mueller | 285/177 |
| 1,033,196 | 7/1912 | Roesch | 285/177 |
| 1,237,056 | 8/1917 | Kitchen | 15/104.16 |
| 1,556,494 | 10/1925 | Cooper | 15/104.165 |
| 2,544,847 | 3/1951 | Malesky | 15/104.165 |
| 2,559,376 | 7/1951 | Schnitger | 42/1 N |
| 2,616,109 | 11/1952 | Gardner | 15/104.165 |
| 2,897,525 | 8/1959 | Goodwin et al. | 15/104.165 |
| 3,137,957 | 6/1964 | Ingalls | 42/1 N |
| 4,010,565 | 3/1977 | DiProspero | 42/1 R |

*Primary Examiner*—Charles T. Jordan
*Attorney, Agent, or Firm*—Gifford, VanOphem, Sheridan & Sprinkle

[57] ABSTRACT

A gun barrel cleaning device comprising an elongated flexible shaft having a slotted link swively secured to one end of the shaft and a tubular coupling having a threaded axial bore swively secured to the other end of the shaft. An adapter sleeve is also provided and has a threaded stem at one end adapted to threadably engage the threaded bore of the tubular coupling and at its other end has an internally threaded axial bore. The threaded bore of the adapter sleeve is dimensioned to threadably engage an enlarged threaded stem of a cylindrical cleaning brush appropriately sized for cleaning the barrel of a shotgun while the threaded bore of the tubular coupling is dimensioned to threadably engage the smaller diameter stem of a cylindrical brush member appropriately sized for use in cleaning a rifle barrel. The slotted link is used to hold a cleaning patch inserted through the slot.

6 Claims, 2 Drawing Figures

FLEXIBLE CLEANING SHAFT WITH BRUSH ADAPTER

BACKGROUND OF THE INVENTION

I. Field of the Invention

The present invention relates generally to a flexible rifle and shotgun brush cleaning device and, more particularly, to such a device having an adapter which enables the device to be used with a variety of brush sizes.

II. Description of the Prior Art

Many previously-known gun cleaning rods are made of an elongated rigid rod having a cleaning brush secured to one end. Generally, the brush is a cylindrical brush having radially extending bristles. Alternatively, the rod has an elongated slot through which a cleaning patch is inserted and held. Although such devices can effectively clean the gun barrel, they are quite cumbersome and difficult to store.

Moreover, it is quite common for a gun owner to have more than one gun, each gun having a particular but different diameter barrel. Thus, an appropriately sized brush dimensioned to fit each particular barrel size must be used in order to adequately clean the barrel without scoring or damaging the barrel. For example, a shotgun generally has a barrel with a much larger diameter than a rifle barrel. Thus, a different brush must be used for cleaning each barrel. Therefore, with the above-mentioned previously-known gun cleaners, it is necessary to buy and store two different cleaning devices. In addition, when an absorbent cleaning patch is to be used as well, it is necessary to acquire yet another cleaning device.

One previously-known device that overcomes some of the above-mentioned disadvantages is disclosed in the U.S. Pat. No. 2,559,376 to Schnitger. Schnitger discloses an elongated gun cleaning device constructed of a plurality of axially aligned pieces which can be partially disassembled. Nevertheless, a large portion of the elongated device comprises a rigid rod to which additional pieces can be added. Thus, the device is still quite cumbersome to store and, more importantly, requires reassembly of the gun cleaning device before it can be used to clean a gun barrel. Such assembly is time-consuming and difficult to accomplish.

Another known type of gun barrel cleaning device is disclosed in the U.S. Pat. No. 2,544,847 to Malesky. Malesky discloses a gun cleaning device having an elongated but flexible shaft, a slotted link swively secured to one end of the elongated rod, said link having a slot through which a cleaning patch can be inserted, and an internally threaded coupling swively secured to the opposite end of the rod to which a cleaning brush is attached. In addition, the Malesky device includes a sleeve member entrained between the ends of the flexible shaft but axially slidable along the flexible shaft. The throughbore of the tubular sleeve is sufficiently wide to permit the sleeve member to slide over the slotted link and permit a portion of the sleeve to extend outwardly past the end of the link. The outwardly extending portion of the tubular sleeve has a threaded bore which cooperates with the threaded stem of a second brush member. The second brush member is larger than the brush member secured by the coupling member at the other end of the shaft.

Such a construction, however, is disadvantageous in that the cleaning patch extending through the slotted link must first be removed before the tubular sleeve can be slid over the slotted link in order to secure the brush to it. Therefore, both the stemmed cleaning brush and the cleaning patch are both accessible for use in cleaning only a rifle barrel. Conversely, only the cleaning patch, or alternatively, the cylindrical brush is readily accessible for use when cleaning a shotgun barrel.

SUMMARY OF THE PRESENT INVENTION

The present invention overcomes the above-mentioned disadvantages by providing a gun cleaning device having an elongated flexible shaft, a slotted link swively secured to one end of the flexible shaft and through which a cleaning patch can be inserted, a tubular coupling member swively secured to the other end of the flexible shaft and a tubular adapter sleeve having a stem portion which can be threadably engaged with the tubular coupling member. The tubular coupling member is adapted to receive the threaded stem of a cleaning brush dimensioned to clean a rifle barrel. Alternatively, the tubular adapter sleeve is screwed into the coupling member and a cleaning brush appropriately sized for cleaning a shotgun barrel is screwed into the adapter sleeve.

The present invention also provides a gun cleaning device which can be coiled; due to the flexible shaft, and thus easily stored. More importantly however, the device of the present invention provides both a cleaning patch and a cylindrical brush for cleaning a gun barrel regardless of the type of gun barrel to be cleaned.

BRIEF DESCRIPTION OF THE DRAWINGS

The present invention can be better understood by reference to the following detailed description when read in conjunction with the accompanying drawing in which like reference characters refer to like parts in the different views and in which.

DETAILED DESCRIPTION OF THE PRESENT INVENTION

Figure 1:
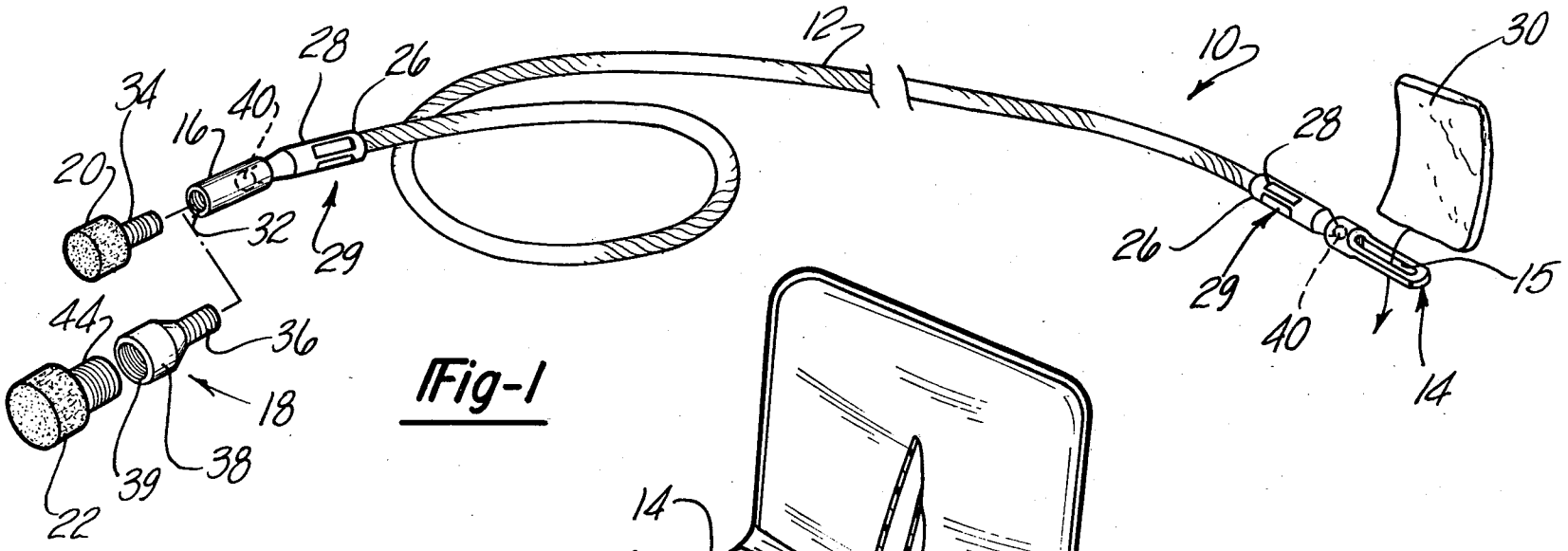
FIG. 1 is a partially exploded perspective view of the cleaning device of the present invention.

Referring now to FIG. 1, the present invention 10 is thereshown comprising an elongated flexible shaft 12, a slotted link member 14 secured at one end of the elongated shaft 12, and a tubular coupling 16 secured to the other end of the shaft 12. The slotted link member 14 is adapted to receive a cleaning patch 30 through its elongated slot 15 in the well-known manner.

The shaft 12 is preferably made of several layers of tightly wound metal coil. Therefore, although the shaft 12 is flexible and therefore easily coiled or wound up, the shaft is resistant to torque. Thus, when the shaft is substantially straight as when it is inserted into a gun barrel, rotation of one end of the shaft causes the opposite end of the shaft 12 to rotate in a like manner. Each end of the shaft 12 is provided with a fitting 26 having a tubular portion 28 secured over the end of the shaft 12 by appropriate means such as crimping indentations 29. The outwardly extending or free end of the fitting 26 has a ball 40 adapted to be received in a socket of either the link member 14 or the tubular coupling 16.

The tubular coupling 16 has an internally threaded bore 32 while a brush member 20 has a cooperating externally threaded stem 34. Similarly, a tubular adapter sleeve 18 is provided with a cooperating externally threaded stem 36 and also includes a tubular portion 38 having an internally threaded bore 39. Either the adapter sleeve 18 or the brush 20 can be alternatively secured to the coupling 16.

A cylindrical brush member 22 for use in cleaning shotgun barrels is also provided and is substantially larger than the cylindrical brush member 20 used for cleaning rifle barrels. Like the brush member 20, the brush member 22 includes an externally threaded stem 44 which typically has a larger diameter than the threaded stem 34 of the brush member 20. The threaded bore 39 of the sleeve 18 is correspondingly larger than the bore 32 of the tubular coupling 16 and is dimensioned to threadably cooperate with the external threads on the stem 44 of cylindrical brush 22.

Having thus defined the components of the cleaning device of the present invention, the operation of this device will now be described. When it is desired to use the device for cleaning a shotgun barrel, an appropriately sized pad 30 is inserted through the slot in the link member 14. In addition, the stem 36 of the sleeve 18 is threadedly connected to the tubular coupling 16. The threaded stem 44 of brush 22 is then screwed into the threaded bore 39 of the sleeve 18. Thus, both the cleaning patch 30 and the cleaning brush 22 are readily accessible for use in cleaning the shotgun barrel. Consequently, either end of the cleaning device 10 can be inserted into the gun barrel and manipulated in the conventionally well-known manner.

When it is desired to clean the barrel of a rifle, the sleeve 18 is removed from the tubular coupling 16 and replaced by the cylindrical brush 20. In addition, the cleaning patch 30 can be replaced by a smaller cleaning patch. Thus, both ends of the cleaning device 10 are readily accessible for use in cleaning the gun barrel of a rifle by inserting one of the ends into the gun barrel and manipulating the device 10 in the conventional manner.

Figure 2:
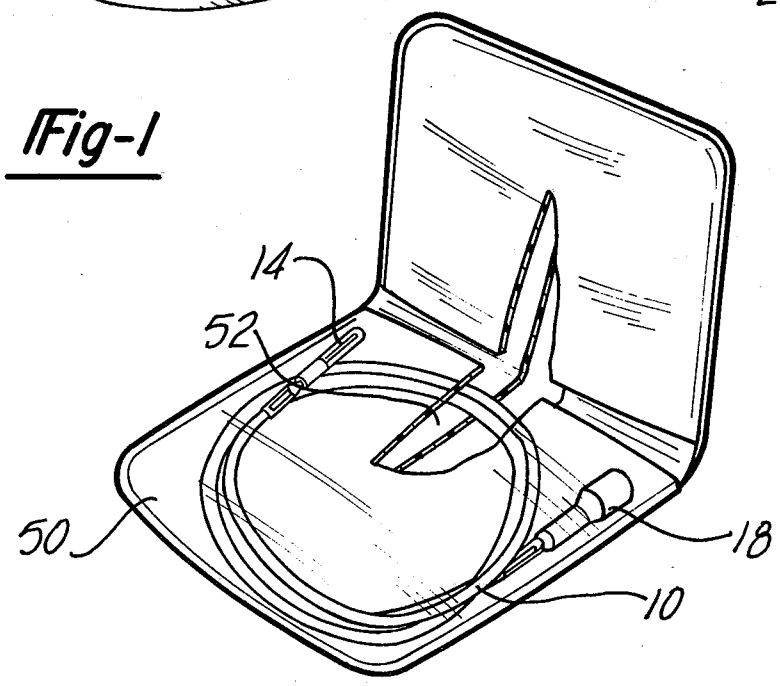
FIG. 2 is a perspective view of the cleaning device shown in FIG. 1 in its storage position.

After the cleaning has been completed, the flexible shaft 12, is easily coiled as shown in FIG. 2 and thus becomes very compact and can be easily stored. A particularly convenient storage device is shown in FIG. 2 and comprises a folding envelope 50 having a pocket 52 into which the coiled cleaning device 10 can be easily inserted. Such an envelope 50 can be easily inserted into a pocket of a hunter's clothing and thus is easily transported and readily accessible to the hunter at all times.

Thus, the present invention provides a lightweight gun cleaning device which can be easily stored and carried. Moreover, both ends of the cleaning device can be provided with cleaning implements adapted for use in cleaning either shotgun barrels or rifle barrels.

Having thus described my invention, many modifications thereto will become apparent to those skilled in the art to which it pertains without departing from the spirit of the invention and the scope as defined in the appended claims.

What is claimed is:

1. A gun barrel cleaner comprising:

a flexible but torque resistant shaft;

a link having an elongated slot;

means for swively securing said link to one end of said shaft;

a first coupling having a threaded internal bore;

means for swively securing said coupling to the other end of said shaft, and an adapter sleeve having a threaded internal bore which is larger than said bore in said first coupling, said adapter sleeve having a threaded stem which threadably and detachably engages the threaded internal bore of said coupling.

2. The invention as defined in claim 1 and further comprising at least two brushes, each of said brushes having a threaded stem and wherein the threaded stem of one brush is dimensioned to threadably engage the internal bore of said coupling and wherein the threaded stem of the other brush is dimensioned to threadably engage the internal bore of said adapter sleeve.

3. The invention as defined in claim 2 wherein one brush includes a cylindrical main body portion dimensioned to engage the inner periphery of a rifle barrel.

4. The invention as defined in claim 3 wherein the other brush includes a cylindrical main body portion dimensioned to engage the inner periphery of a shotgun barrel.

5. The invention as defined in claim 1 wherein the adapter sleeve is of a one-piece construction.

6. The invention as defined in claim 2 further comprising:

means for mutually exclusively securing one of said at least two brushes and the other of said at least two brushes to the other end of said shaft; and a cleaning patch inserted in said slot; whereby by selectively choosing between the one and the other of said two brushes, a cleaning patch and at least one brush is provided to clean two different sized gun barrels.

* * * * *